US005568562A

United States Patent [19]

Huang

[11] Patent Number: 5,568,562

[45] Date of Patent: Oct. 22, 1996

[54] RELEASABLY MOUNTED COMPOUND LOUDSPEAKERS

[75] Inventor: Chia-Po Huang, Taoyuan Hsien, Taiwan

[73] Assignee: Vocal Co., Ltd., Taiwan

[21] Appl. No.: 345,002

[22] Filed: Nov. 28, 1994

[51] Int. Cl.[6] ..... H04R 25/00

[52] U.S. Cl. ..... 381/186; 381/182; 381/199; 381/205

[58] Field of Search ..... 381/188, 205, 381/199, 192, 190, 195, 198, 201, 182, 184, 186, 87; 181/144, 148

[56] References Cited

U.S. PATENT DOCUMENTS

| | | | |
|---|---|---|---|
| 4,365,114 | 12/1982 | Soma | 381/182 |
| 4,451,928 | 5/1984 | Murayama | 381/205 |
| 5,444,790 | 8/1995 | Kogen | 381/189 |

*Primary Examiner*—Sinh Tran
*Attorney, Agent, or Firm*—Brooks & Kushman P.C.

[57] ABSTRACT

A loudspeaker system includes a first loudspeaker driver with a voice coil mounted thereon and a second loudspeaker driver with a voice coil mounted thereon. A carrier has a bearing plate and a leg member which is mounted to the first loudspeaker driver for supporting and spacing the bearing plate apart from the first loudspeaker driver. The bearing plate has a flat bearing surface. A support plate can support the second loudspeaker driver and has a flat base surface disposed on the bearing surface of the bearing plate. A retaining unit can retain releasably the support plate on the bearing plate. First and second contact members are mounted respectively to the bearing and base surfaces of the bearing and support plates. A connecting unit can connect electrically the first and second contact members to the voice coils of the first and second loudspeaker drivers, respectively. The first and second contact members make electrical contact with each other when the support plate is disposed on the bearing plate.

2 Claims, 6 Drawing Sheets

RELEASABLY MOUNTED COMPOUND LOUDSPEAKERS

BACKGROUND OF THE INVENTION

1. Field of the Invention

This inventions relates to a loudspeaker system, more particularly to a loudspeaker system which has a plurality of loudspeaker drivers that can be used in different frequency ranges from a low-frequency range to a high-frequency range so as to reproduce different sounds.

2. Description of the Related Art

The improvement of this invention is directed to a conventional loudspeaker system, as shown in FIG. 2. The conventional loudspeaker system includes a low-frequency loudspeaker driver or woofer 1, a mid-frequency loudspeaker driver or midrange 2, and a high-frequency loudspeaker driver or tweeter 3. The midrange 2 and the tweeter 3 are mounted to the woofer 1 by means of a carrier 4 so as to constitute the loudspeaker system.

Referring to FIG. 1, the woofer 1 has an accommodation space (1*b*) formed in a central portion thereof, and a hole (1*a*) formed through a base wall of the woofer 1 and communicated with the accommodation space (1*b*).

The carrier 4 includes a leg member (4*a*) which is inserted tightly into the accommodation space (1*b*) of the woofer 1 and which has an axially extending passageway (4*b*) formed therethrough and communicated with the hole (1*a*). The carrier 4 further includes a first bearing plate (4*c*) supported securely by the leg member (4*a*), and a second bearing plate (4*d*) projecting laterally and outwardly from the first bearing plate (4*c*) and having a hole 4*e*) formed therethrough.

The midrange 2 has a base plate (2*a*) which is disposed on the first bearing plate (4*c*) of the carrier (4) and which has an inwardly threaded hole (2*b*) formed in the base plate (2*a*) and communicated with the passageway (4*b*). A bolt 5 extends through the hole (1*a*) and the passageway (4*b*). The bolt 5 has an outwardly threaded tail portion (5*a*) engaging the inwardly threaded hole (2*b*) of the base plate (2*a*), and a disc-like head portion (5*b*) depressing against the base wall of the woofer 1 so as to retain the base plate (2*a*) on the first bearing plate (4*c*) and simultaneously position the leg member (4*a*) within the accommodation space (1*b*).

The tweeter 3 is retained on the second bearing plate (4*d*) by means of another bolt 6 which extends through the hole (4*e*) to engage a base portion (3*a*) of the tweeter 3 in the same manner as that of the midrange 2.

When the woofer 1, the midrange 2 and the tweeter 3 are combined together, a conductor wire 9 is employed to interconnect voice coils of the woofer 1, the midrange 2 and the tweeter 3. First of all, the conductor wire 9 has to be connected electrically to the voice coil 8 of the woofer 1. Then, the conducting wire 9 is welded successively on the second bearing plate (4*d*) at a location (7*c*), on the tweeter 3 at a location (7*b*), and on the midrange 2 at a location (7*a*) so as to connect electrically the voice coil 8 of the woofer 1 to the voice coils of the tweeter 3 and the midrange 2.

Because the loudspeaker drivers are combined together with the use of the bolts, the combination of the loudspeaker drivers is quite difficult. In addition, because the conductor wire 9 has to be welded on the loudspeaker drivers successively after the loudspeaker drivers are combined together so as to form an electrical connection among the voice coils of the loudspeaker drivers, it is quite inconvenient to replace one of the loudspeaker drivers with a new one when the former is damaged.

SUMMARY OF THE INVENTION

Therefore, the main objective of this present invention is to provide a loudspeaker system which has several loudspeaker drivers that can be combined easily together in a novel manner.

Another objective of this present invention is to provide a loudspeaker system which applies an improved electrical connection manner for interconnecting electrically loudspeaker drivers of the loudspeaker system so as to facilitate replacement of one of the loudspeaker drivers with a new one when the former is damaged.

According to this invention, a loudspeaker system includes a first loudspeaker driver with a voice coil mounted thereon, a second loudspeaker driver with a voice coil mounted thereon, a support plate for the second loudspeaker driver, and a carrier for carrying the support plate.

The carrier has a bearing plate and a leg member which is mounted to the first loudspeaker driver for supporting and spacing the bearing plate apart from the first loudspeaker driver. The bearing plate has a flat bearing surface. The support plate has a flat base surface disposed on the bearing surface of the bearing plate.

The loudspeaker system further includes means for retaining releasably the support plate on the bearing plate, first and second contact members mounted respectively to the bearing and base surfaces of the bearing and support plates, and means for connecting electrically the first and second contact members to the voice coils of the first and second loudspeaker drivers, respectively. The first and second contact members make electrical contact with each other when the support plate is disposed on the bearing plate.

The retaining means includes a retaining member mounted securely on the bearing surface of the bearing plate, and an engagement member mounted securely on the base surface of the support plate. The engagement member is engageable with the retaining member for retaining releasably the support plate on the bearing plate.

One of the retaining and engagement members is a magnetic piece. The other one of the retaining and engagement members is a magnetizable piece.

In addition, the retaining member can also include two parallel spaced hook plates extending from the bearing surface toward the base surface and having inwardly bent barb-like end portions. The engagement member can also include an insert piece which extends from the base surface toward the bearing surface between the hook plates, and which has two outwardly bent barb-like flanges that are engageable with the barb-like end portions of the hook plates, respectively.

The first and second contact members are metal sheets which have first sections that are positioned respectively on the bearing and base surfaces of the bearing and support plates, and second sections that extend respectively through the bearing and support plates and that have distal ends which are exposed respectively at the sides of the bearing and support plates opposite to the bearing and base surfaces. One of the first sections of the metal sheets has a resilient protruded portion to contact directly the other one of the first sections. The electrical connecting means includes conductor wires which are connected respectively to the distal ends of the second sections of the first and second contact members.

Preferably, the loudspeaker system further includes an intermediate contact body disposed between the first and second contact members. The bearing plate has a housing to receive the intermediate contact body. The intermediate contact body is biased to protrude outwardly of the housing to contact the second contact member. The first contact member is secured to the housing externally and has a protruded portion which extends into the housing to contact the intermediate contact body.

The loudspeaker system further includes means for aligning the first and second contact members when the support plate is disposed on the bearing plate.

The aligning means includes a dent formed in the base surface of the support plate, and a nose projecting from the bearing surface of the bearing plate to extend into the dent when the support plate is retained on the bearing plate, thereby preventing displacement between the first and second contact members.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
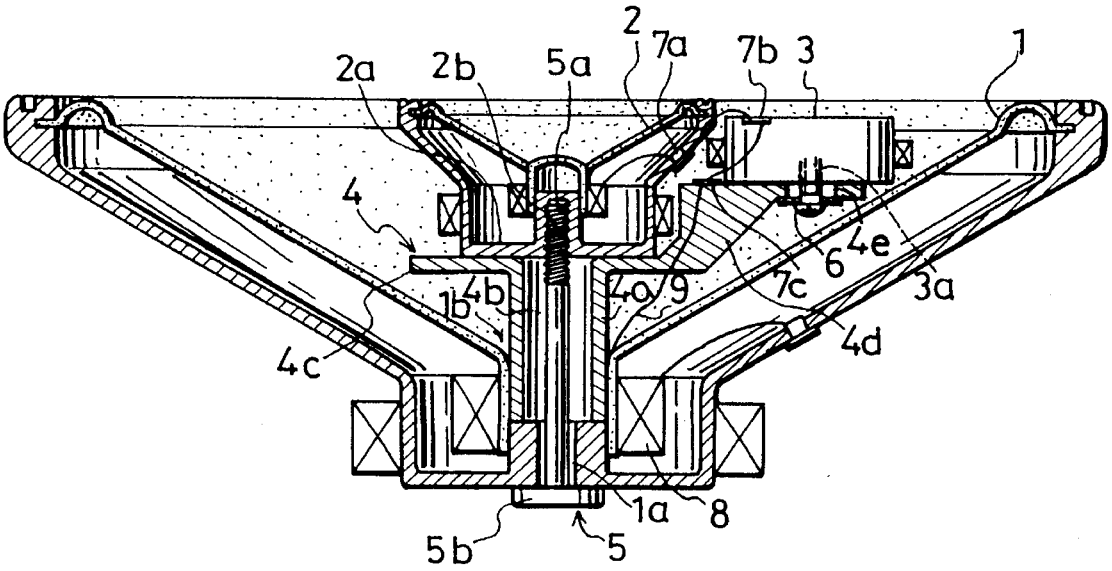
FIG. 1 PRIOR ART
FIG. 1 is a sectional view showing a conventional loudspeaker system.
Figure 2:
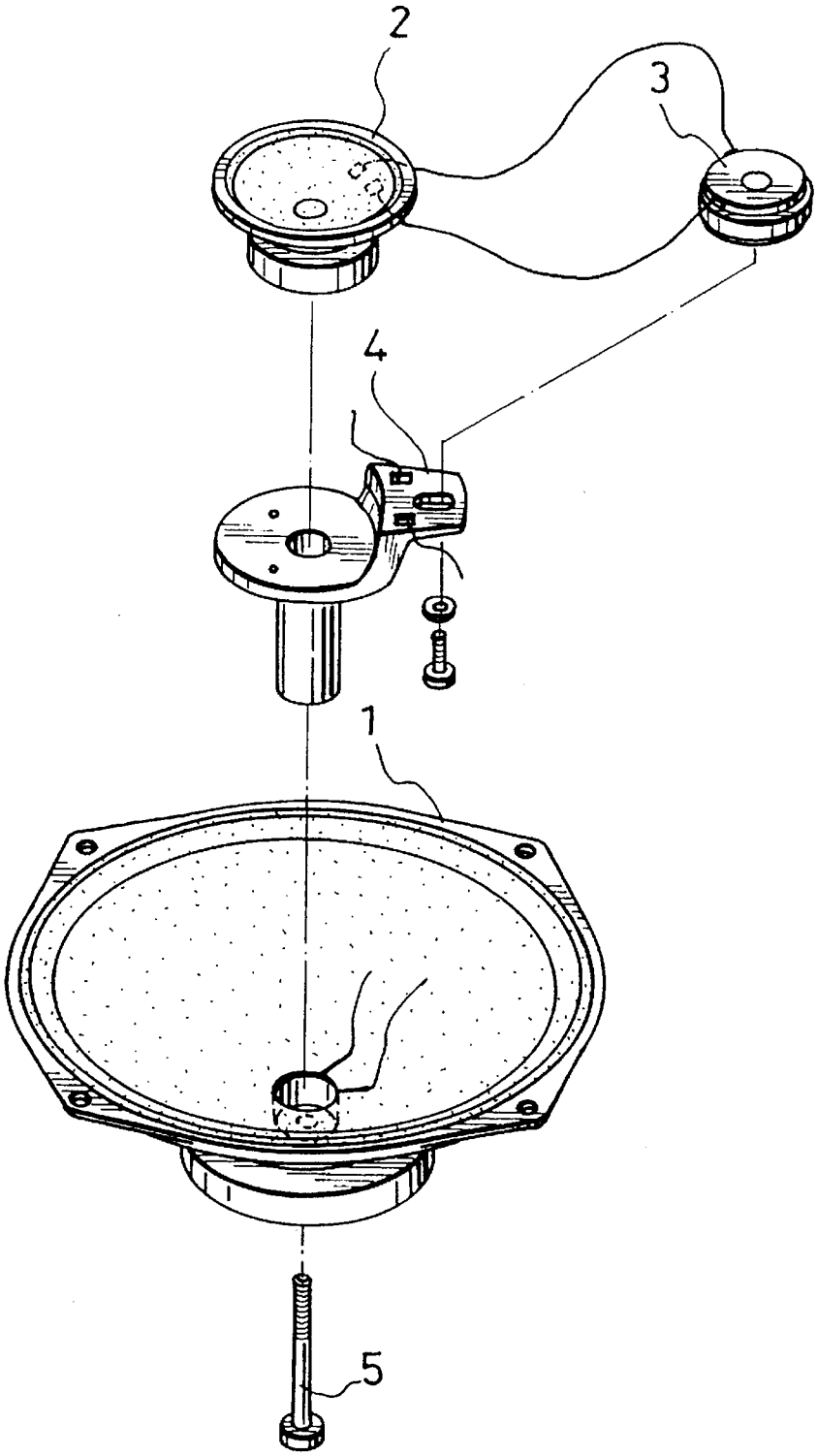
FIG. 2 PRIOR ART
FIG. 2 is an exploded view showing the conventional loudspeaker system.
Figure 3:
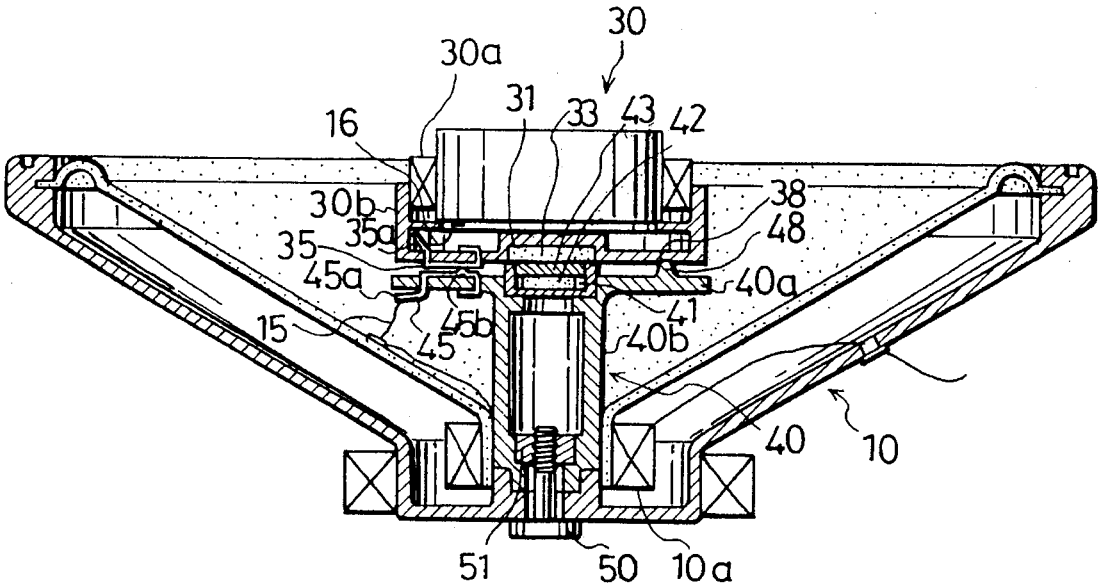
FIG. 3 is a sectional view showing the first preferred embodiment of a loudspeaker system of this invention.
Figure 4:
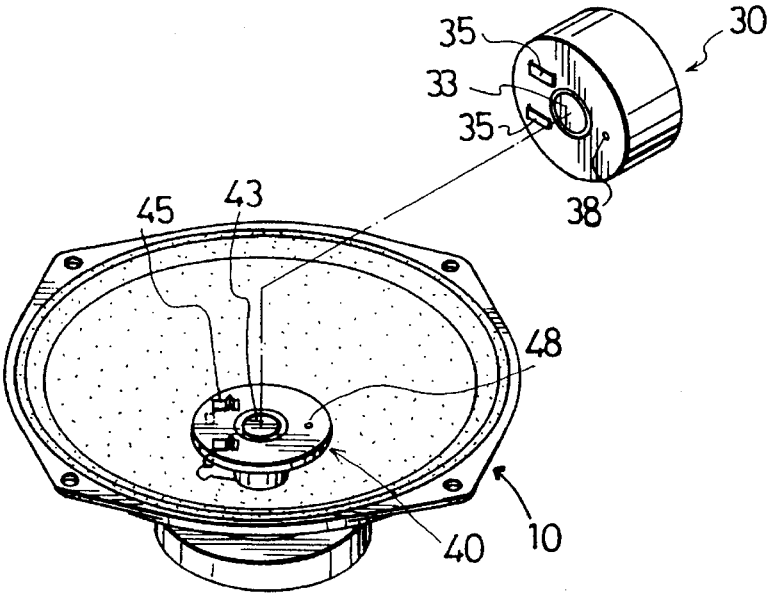
FIG. 4 is an exploded view showing the loudspeaker system according to the first preferred embodiment of this invention.

Referring to FIGS. 3 and 4, the first preferred embodiment of a loudspeaker system of this invention includes a first loudspeaker driver 10, a second loudspeaker driver 30 and a carrier 40. The first loudspeaker driver 10 is a low-frequency loudspeaker driver or woofer and has a voice coil (10*a*) mounted thereon. The second loudspeaker driver 30 is a high-frequency loudspeaker driver or tweeter and has a voice coil (30*a*) mounted thereon.

Referring to FIG. 4, the carrier 40 has a bearing plate (40*a*) and a leg member (40*b*) which is inserted tightly into a central accommodation space of the first loudspeaker driver in a known manner. Then, a bolt 50 extends through a hole, which is formed through a base wall of the first loudspeaker driver 10, and into a bottom end portion of the leg member (40*b*). A nut 51 is mounted threadably on an outwardly threaded distal end portion of the bolt 50 in order to retain the leg member (40*b*) on the first loudspeaker driver 10. The bearing plate (40*a*) is supported securely by the leg member (40*b*) so as to be spaced apart from the first loudspeaker driver 10 at a predetermined distance. The bearing plate (40*a*) has a flat bearing surface and a recess 41 formed in a central portion of the bearing surface.

A support plate (30*b*) is used for supporting the second loudspeaker driver 30 and has a flat base surface disposed on the flat bearing surface of the bearing plate (40*a*). The flat base surface of the support plate (30*b*) has a recess 31 formed therein in alignment with the recess 41 when the support plate (30*b*) is disposed on the bearing plate (40*a*).

The loudspeaker system further includes means for retaining releasably the support plate (30*b*) on the bearing plate (40*a*), a pair of contact units, each of which consists of first and second contact members 45, 35 that are mounted respectively to the bearing and support plates (40*a*, 30*b*), and means for connecting electrically the first and second contact members 45, 35 to the voice coils (10*a*, 30*a*) of the first and second loudspeaker drivers 10, 30, respectively.

The retaining means includes a retaining member which is a magnetic piece 42 disposed in the recess 41 of the bearing plate (40*a*), a metal plate 43 mounted in the recess 41 to cover the magnetic piece 42, and an engagement member which is a magnetizable piece 33 that is mounted in the recess 31 of the support plate (30*b*). The retaining member and the engagement member together constitute a retaining unit. When the support plate (30*b*) is disposed on the bearing plate (40*a*), the magnetic piece 42 is magnetically engageable with the magnetizable piece 33 for retaining the support plate (30*b*) on the bearing plate (40*a*), thereby holding the first and second loudspeaker drivers 10, 30 together.

The first and second contact members 45, 35 of each of the contact units are metal sheets which have first sections that are positioned respectively on the bearing and base surfaces of the bearing and support plates (40*a*, 30*b*) and that contact electrically with each other when the support plate (30*b*) is retained on the bearing plate (40*a*), and second sections that extend respectively through the bearing and support plates (40*a*, 30*b*) and that have distal ends (45*a*, 35*a*) exposed at the sides of the bearing and support plates (40*a*, 30*b*) opposite to the bearing and base surfaces, respectively. The first section of the first contact member 45 has a resilient protruded portion (45*b*) which extends toward support plate (30*b*) to contact directly the first section of the second contact member 35 in order to facilitate electrical contact of the first sections of the first and second contact members 45, 35.

The electrical connecting means includes two conductor wires 15, 16 which are fixed respectively to the distal ends (45*a*, 35*a*) of the first and second contact members 45, 35. Then, the conductor wires 15, 16 connect electrically the distal ends (45*a*, 35*a*) of the first and second contact members 45, 35 to the voice coils (10*a*, 30*a*) of the first and second loudspeaker drivers 10, 30, respectively, thereby forming an electrical connection between the voice coils (10*a*, 30*a*) of the first and second loudspeaker drivers 10, 30.

The loudspeaker system further includes means for aligning the first and second contact members 45, 35 when the support plate (30*b*) is to be mounted on the bearing plate (40*a*). The aligning means includes a dent 38 formed in the base surface of the support plate (30*b*), and a nose 48 projecting from the bearing surface of the bearing plate (40*a*) and extending into the dent 38 when the support plate (30*b*) is retained on the bearing plate (40*a*), thereby preventing displacement between the first and second contact members 45, 35 and simultaneously preventing sliding movement of the support plate (30*b*) relative to the bearing plate (40*a*).

Figure 5:
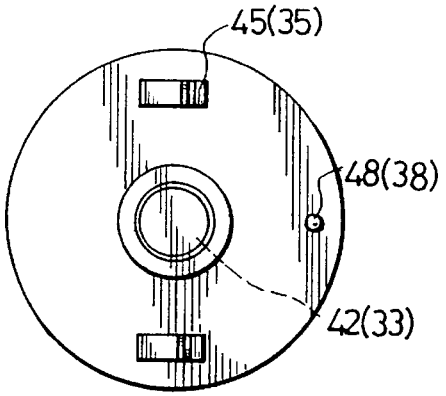
FIG. 5 is a schematic view illustrating the assembly of electrical contacts of the loudspeaker system in accordance with the first preferred embodiment of this invention.

FIG. 5 further illustrates the combination and electrical contact of the first and second loudspeaker drivers 10, 30.

With the use of the magnetic and magnetizable pieces 42, 33, the first and second loudspeaker drivers 10, 30 can be easily combined to each other and can be easily removed from each other. In addition, there is no need to weld the conductor wires 15, 16 on the first and second loudspeaker drivers 10, 30 when the second loudspeaker driver 30 is mounted on the first loudspeaker driver 10. Accordingly, it is quite easy to replace one of the first and second loudspeaker drivers 10, 30 with a new one when the former is damaged.

Figure 6:
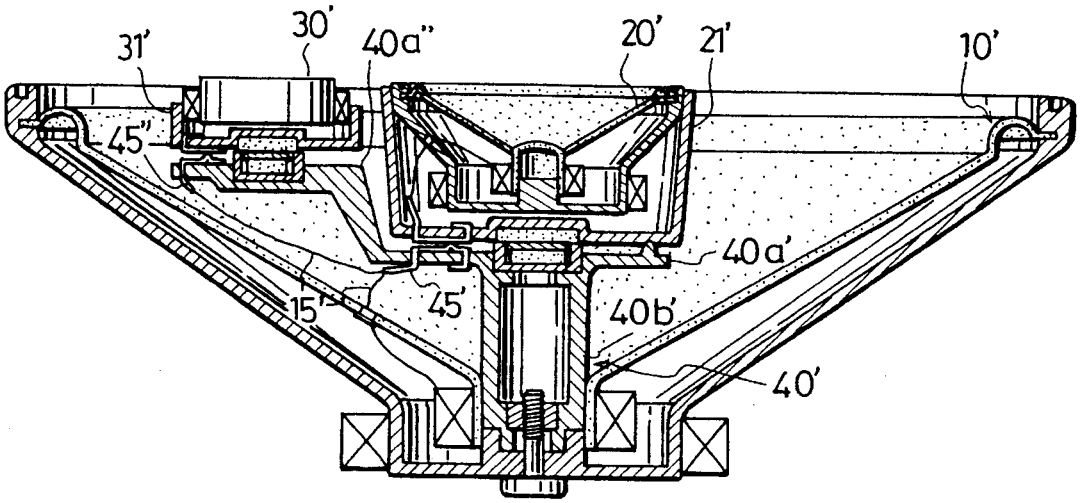
FIG. 6 is a sectional view showing the second preferred embodiment of a loudspeaker system of this invention.

Referring to FIG. 6, the second preferred embodiment of a loudspeaker system of this invention includes a first loudspeaker driver 10', a second loudspeaker driver 20', a third loudspeaker driver 30' and a carrier 40'. The first loudspeaker driver 10' is a low-frequency loudspeaker driver or woofer similar in construction to the woofer of the first embodiment. The second loudspeaker driver 20' is a mid-frequency loudspeaker driver or midrange which has a voice coil mounted thereon. The third loudspeaker driver 30' is a high-frequency loudspeaker driver or tweeter similar in construction to the tweeter of the first embodiment. It is noted that the electrical contacts of the first, second and third loudspeaker drivers 10', 20', 30' are similar to those of the first preferred embodiment.

The carrier 40' includes a leg member (40*b'*), a first bearing plate (40*a'*) and a second bearing plate (40*a''*). The leg member (40*b'*) and the first bearing plate (40*a'*) are similar in construction to those of the carrier of the first embodiment and are mounted to the first loudspeaker driver 10' in the same manner as described in the first embodiment. Similarly, a support plate 21' is retained releasably on the first bearing plate (40*a'*) of the carrier 40' in the same manner as described in the first embodiment for supporting the second loudspeaker driver 20'. In this way, the voice coils of the first and second loudspeaker drivers 10', 20' can be connected electrically to each other by means of conductor wires and contact units similar to the first embodiment.

The second bearing plate (40*a''*) projects laterally and outwardly from a peripheral portion of the first bearing plate (40*a'*) and has a flat bearing surface for carrying the third loudspeaker driver 30'. A support plate 31' is retained releasably on the second bearing plate (40*a''*) in a manner similar to that of retaining releasably the support plate 21' on the first bearing plate (40*a'*) for supporting the third loudspeaker driver 30'. Similarly, the voice coil of the third loudspeaker driver 30' is connected electrically to the voice coil of the first loudspeaker driver 10' by means of conductor wires and contact units in the same manner as described in the first embodiment. The conductor wire 15' of the first loudspeaker driver 10' extends from the voice coil of the first loudspeaker driver 10' and is to be connected electrically to the distal ends 45', 45" of the second sections of the first contact members of the second and third loudspeaker drivers 20', 30', respectively so as to form an electrical connection among the voice coils of the first, second and third loudspeaker drivers 10', 20', 30' when the second and third loudspeaker drivers 20', 30' are mounted on the carrier 40'.

It is worth emphasizing again that the second embodiment still has the same advantages as those of the first embodiment of the loudspeaker system as described hereinbefore.

Figure 7:
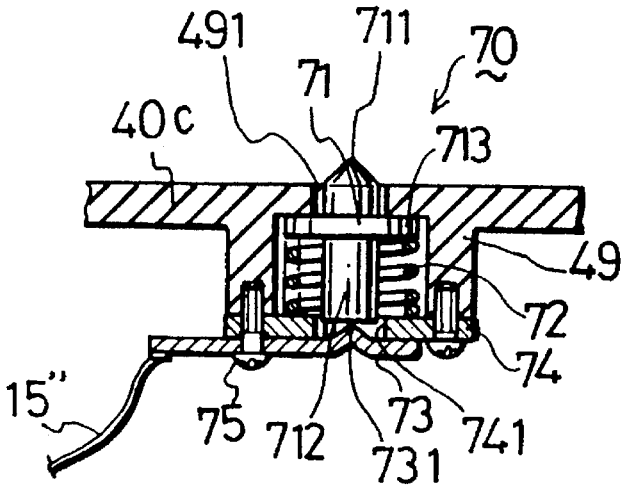
FIG. 7 is a sectional view showing a modified contact unit of the loudspeaker system according to the third preferred embodiment of this invention.
Figure 8:
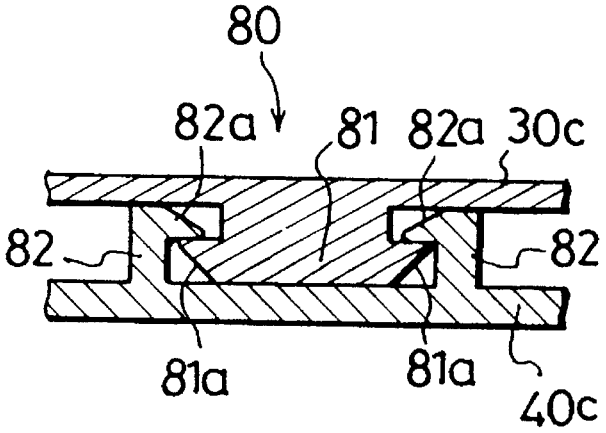
FIG. 8 is a sectional view showing a modified retaining unit of the loudspeaker system according to the third preferred embodiment of this invention.

FIGS. 7 and 8 respectively show the modified contact and retaining units 70, 80 of a loudspeaker system according to the third preferred embodiment of this invention. It is noted that the third embodiment is similar in construction to the first embodiment except for the modified contact and retaining units 70, 80 and a bearing plate (40*c*) of a carrier of the loudspeaker system.

Referring to FIG. 7, the modified contact unit 70 includes a first contact member 73, a second contact member (not shown) which is similar in construction to that of first embodiment and which is mounted on a flat base surface of a support plate (30*c*) (see FIG. 8) in a manner similar to the first embodiment, and an intermediate contact body 71 disposed between the first and second contact members. The bearing plate (40*c*) has a housing 49 secured to a surface thereof opposite to a flat bearing surface thereof, and a hole 491 formed through the bearing plate (40*c*) and communicated with the housing 49. The intermediate contact body 71 is mounted within the housing 49 and has a tail portion 712, a head portion 711 that extends through the hole 491 toward the second contact member, and a shoulder 713 with a size larger than that of the hole 491 so as to prevent removal of the intermediate contact body 71 from the housing 49. An annular plate 74, with a central hole 741, is secured to the housing 49. A biasing means, which is a torsion spring 72 sleeved on the intermediate contact body 71 and supported by the annular plate 74 so as to retain the intermediate contact body 71 in the housing 49, is used for biasing the intermediate contact body 71 to protrude the head portion 711 outwardly of the housing 49 so as to contact the second contact member. The first contact member 73 is secured to the housing 49 externally by means of a bolt 75, and has a protruded portion 731 extending into the housing 49 via the central hole 741 of the annular plate 74 to contact the tail portion 712 of the intermediate contact body 71. A conductor wire 15" connects the first contact member 73 to a voice coil of a first loudspeaker driver (not shown) of the loudspeaker system. Accordingly, when a second loudspeaker driver of the loudspeaker system is disposed on the carrier, its second contact member can depress against the head portion 711 of the intermediate contact body 71 so as to push the tail portion 712 of the intermediate contact body 71 to contact the protruded portion 731 of the first contact member 73, thereby forming an electrical connection between the first and second contact members. In this way, the voice coils of the first and second loudspeaker drivers can be connected electrically to each other.

Referring to FIG. 8, the modified retaining unit 80 includes a retaining member mounted securely on the bearing surface of the bearing plate (40*c*), and an engagement member mounted securely on the base surface of the support plate (30*c*). The retaining member includes two parallel spaced hook plates 82 extending from the bearing surface toward the base surface and having inwardly bent barb-like end portions (82*a*). The engagement member has an insert piece 81 extending from the base surface toward the bearing surface between the hook plates 82 and having two outwardly bent barb-like flanges (81*a*) that are engageable with the barb-like end portions (82*a*) of the hook plates 82, respectively, so as to retain releasably the support plate (30*c*) on the bearing plate (40*c*), thereby holding the first and second loudspeaker drivers together.

Figure 9:
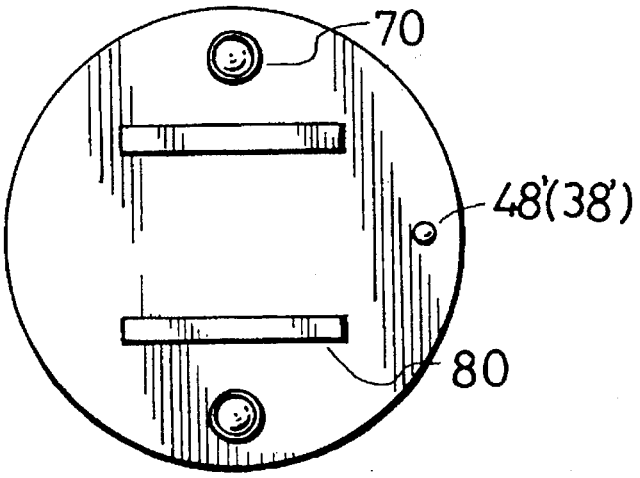
FIG. 9 is a schematic view illustrating the assembly of electrical contacts of the loudspeaker system in accordance with the third preferred embodiment of this invention.

FIG. 9 further illustrates the assembly of the electrical contacts of the third embodiment. The third embodiment has a nose 48' and a dent 38' which constitute an aligning means for aligning the intermediate contact bodies 71 (see FIG. 7) of the contact units 70 with the second contact members when the second loudspeaker driver is mounted on the first loudspeaker driver.

Figure 10:
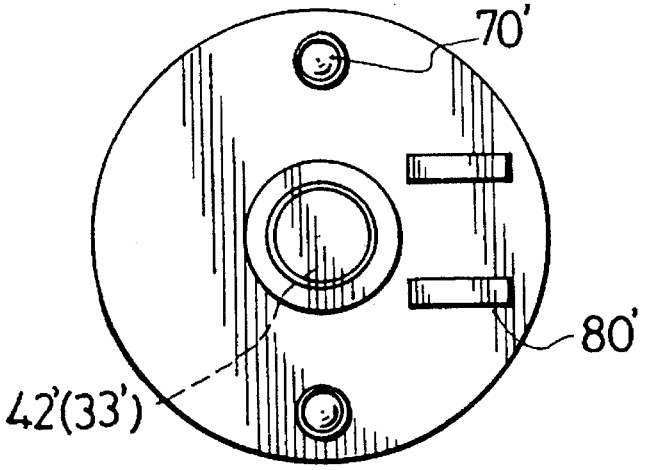
FIG. 10 is a schematic view illustrating the assembly of electrical contacts of a loudspeaker system in accordance with the fourth preferred embodiment of this invention.

FIG. 10 illustrates the assembly of the electrical contacts of a loudspeaker system according to the fourth preferred embodiment of this invention. The fourth embodiment employs magnetic and magnetizable pieces 42', 33', which are similar in construction and in function to the first embodiment, as a retaining unit for combining a second loudspeaker driver to a first loudspeaker driver of the loudspeaker system. Two contact units 70', which are similar in construction and in function to those of the third embodiment, are employed in the fourth embodiment to interconnect electrically the voice coils of the first and second loudspeaker drivers. A retaining unit 80', which is similar in construction and in function to that of the third embodiment, is employed in the fourth embodiment as an aligning means for aligning the intermediate contact bodies with the second contact members of the contact units 70' when the second loudspeaker driver is mounted on the first loudspeaker driver.

While the present invention has been described in connection with what is considered the most practical and preferred embodiment, it is understood that this invention is not limited to the disclosed embodiments but is intended to cover various arrangements included within the spirit and scope of the broadest interpretations and equivalent arrangement.

I claim:

1. A loudspeaker system comprising:

a first loudspeaker driver including a voice coil mounted thereon;

a carrier having a bearing plate and a leg member which is mounted to said first loudspeaker driver for supporting and spacing said bearing plate apart from said first loudspeaker driver, said bearing plate having a flat bearing surface;

a second loudspeaker driver including a voice coil mounted thereon;

a support plate for supporting said second loudspeaker driver, said support plate having a flat base surface disposed on said bearing surface of said bearing plate;

means for retaining releasably said support plate on said bearing plate, wherein said retaining means includes a retaining member mounted securely on said bearing surface of said bearing plate, and an engagement member mounted securely on said base surface of said support plate, said engagement member being engageable with said retaining member for retaining releasably said support plate on said bearing plate, and wherein said retaining member includes two parallel spaced hook plates extending from said bearing surface toward said base surface and having inwardly bent barb-like end portions, said engagement member having an insert piece which extends from said base surface toward said bearing surface between said hook plates, and which has two outwardly bent barb-like flanges that are engageable with said barb-like end portions of said hook plates, respectively;

first and second contact members mounted respectively to said bearing and base surfaces of said bearing and support plates; and means for connecting electrically said first and second contact members to said voice coils of said first and second loudspeaker drivers, respectively, said first and second contact members making electrical contact with each other when said support plate is disposed on said bearing plate.

2. A loudspeaker system comprising:

a first loudspeaker driver including a voice coil mounted thereon;

a carrier having a bearing plate and a leg member which is mounted to said first loudspeaker driver for supporting and spacing said bearing plate apart from said first loudspeaker driver, said bearing plate having a flat bearing surface;

a second loudspeaker driver including a voice coil mounted thereon;

a support plate for supporting said second loudspeaker driver, said support plate having a flat base surface disposed on said bearing surface of said bearing plate;

means for retaining releasably said support plate on said bearing plate;

first and second contact members mounted respectively to said bearing and support plates;

means for connecting electrically said first and second contact members to said voice coils of said first and second loudspeaker drivers, respectively, said first and second contact members making electrical contact with each other when said support plate is disposed on said bearing plate;

further comprising an intermediate contact body disposed between said first and second contact members; and wherein said bearing plate has a housing to receive said intermediate contact body, said intermediate contact body being biased by spring biasing means to protrude outwardly of said housing to contact said second contact member, said first contact member being secured to said housing externally and having a protruded portion which extends into said housing to contact said intermediate contact body.

* * * * *

UNITED STATES PATENT AND TRADEMARK OFFICE

CERTIFICATE OF CORRECTION

PATENT NO. : 5,568,562

DATED : October 22, 1996

INVENTOR(S) : Chia-Po Huang

It is certified that error appears in the above-identified patent and that said Letters Patent is hereby corrected as shown below:

Column 1, line 6
"inventions" should be --invention--;

Column 1, line 32 before
"4e)" insert --(--;

Signed and Sealed this

Twentieth Day of May, 1997

*Attest:*

Bruce Lehman

BRUCE LEHMAN

*Attesting Officer*

*Commissioner of Patents and Trademarks*